US005888136A

United States Patent [19]

Herbert

[11] Patent Number: 5,888,136

[45] Date of Patent: Mar. 30, 1999

[54] WAGERING SYSTEM AND METHOD OF WAGERING

[76] Inventor: Richard A. Herbert, 390 River Bluff Cir., Naperville, Ill. 60540

[21] Appl. No.: 816,872

[22] Filed: Mar. 13, 1997

[51] Int. Cl.[6] ..... A63F 9/22

[52] U.S. Cl. ..... 463/22; 463/25

[58] Field of Search ..... 463/22, 25, 16, 463/17, 18, 19, 20, 40, 28; 273/143 R

[56] References Cited

U.S. PATENT DOCUMENTS

| | | |
|---|---|---|
| 4,652,998 | 3/1987 | Kosa et al. . |
| 4,713,787 | 12/1987 | Rapp . |
| 5,157,602 | 10/1992 | Fields et al. . |
| 5,180,309 | 1/1993 | Egnor . |
| 5,224,706 | 7/1993 | Bridgeman et al. . |
| 5,275,400 | 1/1994 | Weingardt et al. . |
| 5,330,185 | 7/1994 | Wells . |
| 5,332,218 | 7/1994 | Lucey . |
| 5,476,259 | 12/1995 | Weingardt . |
| 5,518,239 | 5/1996 | Johnston . |
| 5,560,603 | 10/1996 | Seelig et al. . |
| 5,564,701 | 10/1996 | Dettor . |
| 5,588,913 | 12/1996 | Hecht . |
| 5,762,552 | 6/1998 | Vuong et al. . |

*Primary Examiner*—Michael O'Neill
*Attorney, Agent, or Firm*—Wood, Phillips, VanSanten, Clark & Mortimer

[57] ABSTRACT

A method of wagering, including the steps of providing a random number generator that has a wagering base which is randomly accessed by an input wager, using as at least a part of the wagering base the outcome of at least one horse/dog race or jai alai game, pre-assigning a probability value to the outcome of the at least one horse/dog race or jai alai game and programming the random number generator so that the probability of accessing the outcome of the at least one horse/dog race or jai alai game in the random number generator through an input wager is correlated to the probability value, directing an input wager identifying the outcome of the at least one horse/dog race or jai alai game to the random number generator and paying a return for an input wager identifying the outcome of the at least one horse/dog race or jai alai game that accesses the outcome of the at least one horse/dog race or jai alai game through the random number generator.

21 Claims, 2 Drawing Sheets

WAGERING SYSTEM AND METHOD OF WAGERING

BACKGROUND OF THE INVENTION

1. Field of the Invention

This invention relates to the gaming industry and, more particularly, to a method of wagering using the outcome of horse/dog races, jai alai games, or the like, as at least a part of a wagering base. The invention is also directed to a wagering system of the type through which the inventive wagering method can be practiced.

2. Background Art

The financial impact of legal gaming on local, national, and international economies is staggering. One source has estimated that, in 1992, Americans spent more on lotteries, race tracks, casinos, and the like, than on movies, books, amusement attractions and recorded music collectively. This same source has estimated that more Americans went to casinos than attended major league baseball games in the U.S. in the year 1993.

The financial heart of the casinos is the slot machine, which has been drawing an increasing percentage of wagers in casinos. Aside from the versatility that modern slot machines afford, they are desirable because they appeal to all levels of gambling expertise. Novices need not contend with the embarrassment of not knowing the mechanics of a particular game, nor does the novice need to study probabilities to make a calculated wager. The intimidation by the table games, the operators thereof, and other observing players has discouraged many players from participating in table games. With a slot machine, on the other hand, the individual need only operate a switch through a button or lever, with the results being entirely random and beyond the operator's control. Slot machines are also desirable because they are commonly set up in state-of-the-art facilities which are highly attractive to the bettor.

The success of the slot machine has had a devastating effect on live track revenues from pari-mutuel betting. Existing legislation in most states has precluded the location of slot machines and other casino games on track premises. These tracks have been relegated to a one dimensional identity, which has resulted in a migration of gamers to casinos. While off-track betting has breathed some life into pari-mutuel betting, many tracks have closed or are anticipating closure in the very near future due to lowering profitability.

The tracks are handicapped by having higher commissions (18–35%) than casinos (0.5% to 11%). Still further, success at a track generally requires extensive study of both race forms and race results as well as an intimate understanding of handicapping. Added to this is the public perception that many track races are "fixed". Still further, many race tracks have undesirable, antiquated facilities, causing people interested in live races to instead frequent off-track facilities.

It is clear that to halt and reverse the downward trend at race tracks, some stimulus must be given to bettors, in the form of more and different betting opportunities, increased potential winnings, etc. Some tracks have already experienced a financial turnaround attributable largely to the legalization of slots thereat.

However, there is an ongoing battle between legislatures that respect the public sentiment to resist the expansion of gambling and lobbyists for the racing industry that see slot machines as a key to survival of these tracks. Survival of race tracks is in the interest of not only those that own these facilities but also to those in peripheral employment. One study by the American Horse Council Federation estimated that there are in excess of seven million participants as horse owners, service providers, and employees, exclusive of spectators. This same study estimated that the horse industry produces goods and services valued at over 25 billion and pays nearly two billion in taxes on all government levels. Since legislative action to permit slot machines and other games is not imminent in many jurisdictions, some remedy for the current race track crisis is necessary.

SUMMARY OF THE INVENTION

One aspect of the present invention is directed to a method of wagering, including the steps of providing a random number generator that has a wagering base which is randomly accessed by an input wager, using as at least a part of the wagering base the outcome of at least one horse/dog race or jai alai game, pre-assigning a probability value to the outcome of the at least one horse/dog race or jai alai game and programming the random number generator so that the probability of accessing the outcome of the at least one horse/dog race or jai alai game in the random number generator through an input wager is correlated to the probability value, directing an input wager identifying the outcome of the at least one horse/dog race or jai alai game to the random number generator and paying a return for an input wager identifying the outcome of the at least one horse/dog race or jai alai game that accesses the outcome of the at least one horse/dog race or jai alai game through the random number generator.

Through the above method, pari-mutuel wagering can be carried out in a "slot machine" format.

The method may further include the steps of providing multiple locations from which input wagers are directed to the random number generator and directing input wagers to the random number generator from each of the multiple locations.

With this arrangement, it is possible to network the wagering to increase the handle.

The return may be paid based upon the number of input wagers identifying the outcome of the at least one horse/dog race or jai alai game that access the outcome of the at least one horse/dog race or jai alai game through the random number generator.

Through this method, a pari-mutuel betting pool is set up.

The method may further include the step of identifying a predetermined wager period and directing an input wager to the random number generator only during the predetermined wager period. A preliminary return amount may be paid for an input wager identifying the outcome of the at least one horse/dog race or jai alai game that accesses the outcome of the at least one horse/dog race or jai alai game through the random number generator before the expiration of the predetermined wager period.

A final return amount may be paid for each input wager identifying the outcome of the at least one horse/dog race or jai alai game through the random number generator after the expiration of the predetermined wager period based upon the total number of input wagers from each of the multiple locations that access the at least one horse/dog race or jai alai game through the random number generator.

The wagering base may include additional information which is pre-assigned a second probability value. The random number generator can be programmed so that the probability of accessing the additional information in the random number generator through an input wager identifying the additional information is correlated to the second probability value. An input wagering terminal can be provided with a selector to allow an input wager to be selectively identified as one of a) the outcome of the at least one horse/dog race or jai alai game and b) the additional information. The method involves directing an input wager identifying the additional information to the random number generator with a return being paid for an input wager identifying the additional information that accesses the additional information through the random number generator.

The input wagering terminal can be operated to cause an input wager to be X randomly identified as at least one of a) the outcome of the at least one horse/dog race or jai alai game and b) the additional information to the random number generator.

The input wager can be directed to the random number generator by processing a discrete object that is inserted into the terminal. This object can be in the form of a card, bill, coin, ticket, and the like.

In one form, the input wagering terminal has a repositionable element that is accessible to an operator. The discrete object is processed by repositioning the repositionable element after the discrete object is inserted.

The method may further include the steps of identifying a money value for each input wager, determining a cumulative money pool value for the total input wagers made from the two locations identifying the outcome of the at least one horse/dog race or jai alai game that access the outcome of the at least one horse/dog race or jai alai game through the random number generator, and paying a return to each input wager identifying the outcome of the at least one horse/dog race or jai alai game that accesses the at least one horse/dog race or jai alai game based on the cumulative money pool value.

To give the location around the input wagering terminal a more realistic feel, an audio and/or visual signal can be produced to one of a) simulate an equestrian event, b) simulate a live race environment, c) assist placement of input wagers, d) identify the beginning of a wagering period, e) identify the end of a wagering period, and f) simulate a live game environment.

The invention is also directed to a wagering system having a random number generator that has a wagering base which is randomly accessed by an input wager, with the wagering base defined by the outcome of at least one horse/dog race or jai alai game with a pre-assigned probability of accessing the outcome of the at least one horse/dog race or jai alai game through each input wager, and a first input wagering terminal for directing an input wager identifying the outcome of the at least one horse/dog race or jai alai game to the random number generator.

A second terminal can be provided for directing an input wager identifying the outcome of the at least one horse/dog race or jai alai game to the random number generator.

A processor can be provided for determining the number of input wagers directed from the first and second terminals to the random number generator identifying the at least one horse/dog race or jai alai game and accessing the at least one horse/dog race or jai alai game in the random number generator.

The first terminal may include an actuator switch for causing an input wager to be directed to the random number generator.

In one form, the first terminal has structure responsive to the insertion of a discrete object by an operator to direct an input wager to the random number generator.

Additional information with a pre-assigned probability of accessing the additional information through each input wager can be used to define another part of the wagering base. A selector can be set in first and second states and in the first state causes an input wager directed to the random number generator to be identified as the at least one horse/dog race or jai alai game. In the second state, the selector causes an input wager directed to the random number generator to be identified as the additional information.

The additional information can be information on the outcome of a horse/dog race or jai alai game. The race can be related to the at least one race or a separate race.

In one form, at least one of the pre-assigned probabilities is the same as the probability of the outcome of the horse/dog race or jai alai game to which it relates.

A selector may be used to cause the input wager directed to the random number generator to be randomly identified as the at least one horse/dog race or jai alai game and the additional information.

Structure may be provided at the input wagering terminal for producing at least one of an audio and visual signal to at least one of a) simulate an equestrian event, b) simulate a live race environment, c) assist placement of input wagers, d) identify the beginning of a wagering period, e) identify the end of a wagering period, and f) simulate a live game environment.

DETAILED DESCRIPTION OF THE DRAWINGS

Figure 2:
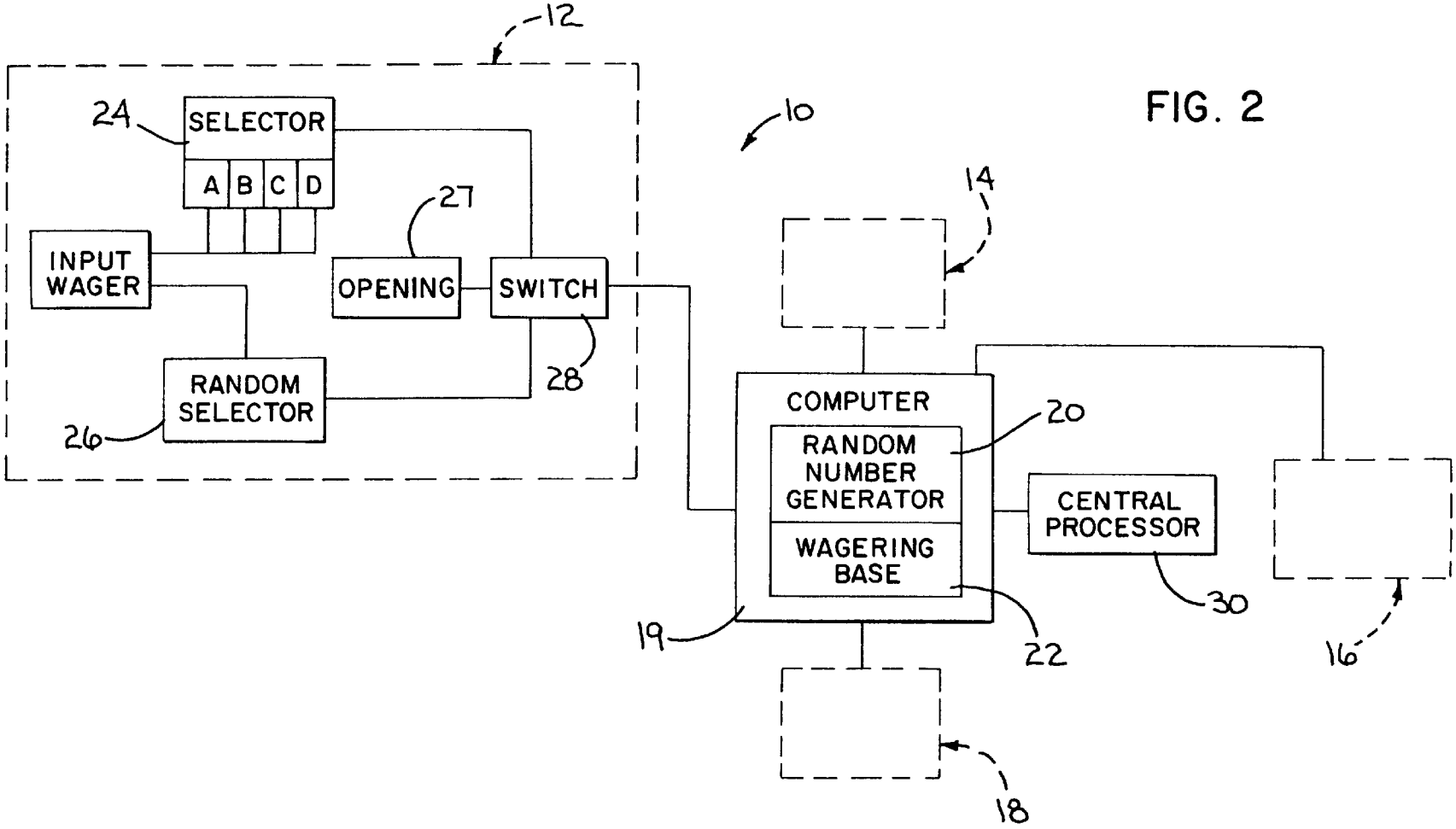
FIG. 2 is a schematic representation of a system for wagering, according to the present invention.

A system for wagering, according to the present invention, is shown at 10 in FIG. 2. The system 10 consists of, in this case, four input wagering terminals 12, 14, 16, 18 through which a bettor makes a wager. The terminals 12, 14, 16, 18 are the same, with only terminal 12 shown and described herein in any detail. It should be understood that any number of terminals 12, 14, 16, 18 can be used. The invention contemplates that a single terminal 12, 14, 16, 18 could be employed. Alternatively, a multitude of terminals 12, 14, 16, 18 can be linked at the same location, intrastate, interstate and/or internationally.

The invention contemplates that pari-mutuel betting, as permitted in most jurisdictions at live race tracks and jai alai facilities, can be carried out in a "slot machine" format. That is, the bettor can realize the advantages of slot machines, with there being potentially different intriguing elements and features added to the basic slot machine function, as described below.

According to the invention, the system utilizes a computer 19 with a random number generator 20 which has a wagering base 22 made up at least in part by the outcome of at least one live race or a jai alai game. Multiple random number generators 20 could be used. The race is preferably a horse or dog race that has already been run. The wagering base 22 does not have to include exclusively outcomes of races or games. Further, it should be understood that the invention pertains to any event on which pari-mutuel betting is permitted and is thus not limited to live races and jai alai games. For purposes of illustration, the description herein will be focused on live races. However, the mechanics of operation are the same for betting on the outcome of jai alai games or other event outcomes on which there is mutuel betting.

The random number generator 20 is programmed so that the probability of "accessing" a particular outcome is correlated to the actual race outcome. For example, the separate odds of a win, perfecta, trifecta and superfecta can be programmed in with the odds of "accessing" the separate outcomes by directing an input wager to the random number generator 20 being based on the actual race odds. Preferably, the odds are substantially the same for the outcomes in the random number generator 20 as the corresponding outcome in the actual race from which the outcomes were taken. As used herein, "access" is used to generically identify a "win" situation, regardless of how the particular wager is input to the random number generator 20 and regardless of how the random number generator 20 actually receives and processes the input wager.

Exemplary input wagering terminal 12 has a number of options for the bettor. For purposes of simplicity, the system 10 will be described with four potential bet options. These options are only exemplary and should not be viewed as limiting. A first selector 24 can be operated to choose bet options A, B, C, D and any combination thereof, with A corresponding to the win, B corresponding to the perfecta, C corresponding to the trifecta, and D corresponding to the superfecta. Alternatively, the bettor can employ a random selector 26 which causes the input wager to be randomly distributed to one or more of the bet options A, B, C, D that are directed to the random number generator 20.

To make a bet, the bettor places a discrete object, which may be a coin, bill, ticket, card, etc., into an opening 27 in the input wagering terminal 12. The bettor then makes a decision as to use of the selector 24 or the random selector 26. If the selector 24 is used, the desired bet is identified. The input wager identifying the chosen option(s) A,B,C,D is then directed to the random number generator 20 by activating a switch 28. A central processor 30 processes all the input wagers, determining the total pool of input wagers, and identifying the number of "winners" that will split the pool. The central processor 30 causes the input wagers that are "losers" to be immediately discarded to avoid further processing other than to identify the wager amount.

Figure 1:
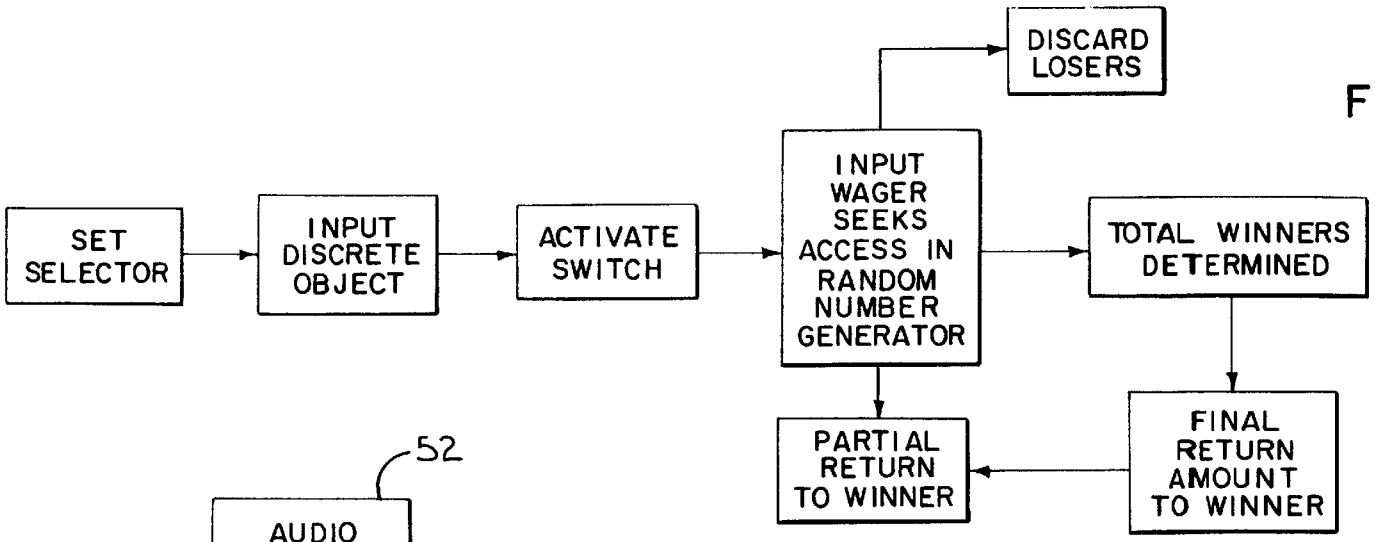
FIG. 1 is a flow diagram illustrating a method of wagering according to the present invention.

One feature of slot machines that makes them particularly desirable is the immediate return that a winner realizes. Another aspect of the invention is the initial identification of the "winners" through the central processor 30 and the immediate pay off of a partial return amount. The amount of the partial return to the winner is conservatively estimated based upon calculated probabilities. At the conclusion of the wagering period, the total pool of input wagers and winners is identified to determine the final return amount to be paid to each winner. This wagering process is shown in flow diagram form in FIG. 1. Conservative estimates on the immediate partial return amount, particularly in large payoff pools, would not significantly dampen the enthusiasm for these games in that the winner would experience the thrill of anticipating a relatively large, but unknown, payoff.

Figure 3:
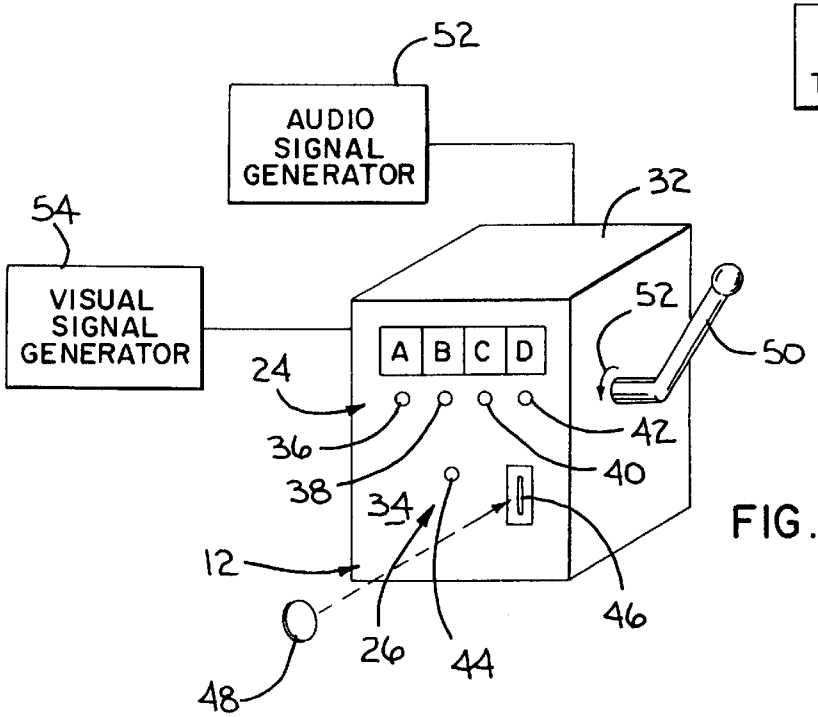
FIG. 3 is a perspective view of an input wagering terminal that is part of the wagering system in FIG. 2.

In FIG. 3, one preferred form of the input wagering terminal 12 is shown. The input wagering terminal 12 includes a housing 32 which simulates the appearance of a conventional slot machine. The housing 32 has a front display wall 34 with the selector 24 having push or slide button operators 36, 38, 40, 42 to identify each input wager as one or a combination of bet options A,B,C,D to be directed to the random number generator 20. Alternatively, the random selector 26 is operated through a push button or slide 44. The bet options A,B,C,D are readily viewable through front windows. The bet options A,B,C,D could be displayed on conventional mechanical reels, as a video image, or by using a combination of both of these technologies.

The housing 32 has a slot/opening 46 for a coin 48 that is processed to initiate the betting process. After inputting the coin 48, a repositionable lever 50, in this case a pivotable operating arm as used on slot machines, is pivoted in the direction of the arrow 50 to operate an internal switch 28 that thereby causes the input wager to be directed to the random number generator 20. With the above described system, the operator will have the convenience and thrill of playing a conventional slot machine, potentially realizing an immediate initial partial return amount, with the added thrill of waiting to anticipate an even higher final return amount after the predetermined racing period has expired.

To add another dimension to the system 12, an audio signal generator 52 and/or a visual signal generator 54 can be used to produce effects that simulate an equestrian event, simulate a live race environment, assist placement of input wagers, identify the beginning of a wagering period, identify the end of a wagering period, simulate a live game environment, or otherwise add to the excitement or authenticity of the system 10.

Some specific wagering processes that might be practiced using the inventive system 10 and method will be described below. After a number of races are run and the results tabulated, some 60–90 or more individual results (example win, quiniela, exacta, trifecta, superfecta) are selected for use by the invention as the wagering base 22. The outcomes can be from the same race or a combination of different races. A typical wagering period may be 5 to 12 minutes.

Outcome No. 1

No. 1 won and paid $12

Outcome No. 2

No. 8-6 perfecta won and paid $50

Outcome No. 3

No. 3-7-9 trifecta won and paid $340

Outcome No. 4

Nos. 9-7-1-2 superfecta won and paid $3,000

The odds for a No. 1 win were 5 to 1, i.e. 1 chance in six. The resulting probability is 0.1666666667. The odds for the perfecta were 24 to 1, i.e. 1 chance in 25. The resulting probability is 0.04. The odds for the trifecta were 169 to 1, i.e. 1 chance in 170. The resulting probability is 0.0058823529. The odds for the superfecta were 2,999 to 1, i.e. 1 chance in 3,000. The resulting probability is 0.0003333333.

The bettor determines how much to bet on a particular outcome. In this particular example, a $2 wager could be made on each of the four or five possible outcomes/bet options A,B,C,D and possibly the quiniela (E). The input wager would typically be from $0.25 up to $50.00. This amount can be more or less depending upon the particular jurisdiction determination.

The bettor is given the option of placing any permitted amount on any one or a combination of the four/five outcomes using the selector 24. Alternatively, the bettor can proceed using the random mode so that the input wager is distributed randomly between the four/five outcomes using the selector 26.

The selector 24 can also be set to allow even distribution of an input wager over the four/five outcomes. This betting technique would be popular as it would produce many small "consolation" payoffs (very similar to the frequent small payoffs of conventional slots). While a player who bet just $0.25 may not access the superfecta, the perfecta outcome might be accessed. In that case, 6¼ cents would have been placed on this outcome as a result of which the bettor would ultimately receive roughly $1.50 back on this bet.

The wagering outcomes can also be "sequenced" so that by betting on and accessing one of the outcomes, one to three of the other outcomes might likewise be accessed. As an example of this, there could be the following four outcomes/bet options.

Win 6 paid $10.00;

perfecta 6-8 paid $52.00;

trifecta 6-8-9 paid $388.00; and superfecta 6-8-9-1 paid $2,940.00.

If the input wager was identified as the 6-8-9-1 outcome, the bettor would win on all four outcomes. An input wager of a 6-8-9-1 outcome would access both the win 6, perfecta 6-8 and trifecta 6-8-9 outcomes. An exemplary payout for the 6-8-9-1 outcome might be $200 for a single quarter. A bet of $0.25 on the superfecta alone might produce $800, with a $2.00 bet potentially returning over $6,000.00.

Once the selector 24, 26 is chosen and set, and the input wager is made, the switch 28 is operated. The outcome is then determined entirely by chance based on the "assigned probability" to each of the outcomes in the random number generator 20. During the wagering period, the non-accessing/losing wagers are discarded as in regular slot machines. Those input wagers that are winners are recorded and an immediate partial return amount is made to the winner.

As an example, the central processor 30 may calculate that 12,000 individual $1.00 win bets were made throughout the entire betting network, with a $12,000 total bet. With a success probability of 1 in 6, 2,000 winning pulls are expected by the assigned probability. Based upon chance, the win pulls will normally vary within the range of 1800 to 2200.

With only four outcomes bet upon in this particular embodiment, large pools can be expected. The large pools allow relatively precise prediction on payoffs, with fairly large probabilities ($3.00 to $500.00).

In this example, if only 1800 winning pulls occurred, the central processor 30 would determine the total available pool as $12,000 minus a 6% commission of $720.00, producing a total pool of $11,280.00. For simplicity, if everyone in the betting system bet $1.00, the pool to be divided by the 1800 winners would be $11,280.00 minus $1800.00 for the win bets, or $9,480.00. This $9,480.00 is divided by 1800 winners, resulting in approximately $6.26 paid off to each win bet. A $2.00 bet would have returned $12.52 as opposed to the "target payoff" of $12.00 that the No. 1 win paid in the actual race.

Were there 2,000 winners, as expected, the payoff of $2.00 would be $11.28. The payoff is less than the expected $12.00 in that the above example was simplified. With the No. 1 win paying $12.00, a 1 in 6 probability was assigned. Because approximately 18% was taken out of the win pool in the actual race, the real betting probability was actually around 1 chance in 7 (0.1428571428) as opposed to the calculated probability of 0.1666666667 above. The random number generator 20, in the actual operative embodiment, will be programmed to reconcile the different commissions between two different betting pools, i.e. the actual versus the inventive. Accordingly, when the expected number of winners, less than the expected number, or more than the expected number, actually result, the appropriate payoff is either below, at, or above the "target payoff".

With this system, operating players can bet in the pari-mutuel format after the races have been run and the outcomes published. "Fixed" races would not affect the outcome.

Special race formats may be set up to produce very large payoffs. For example, a superfecta of around $50,000 could be targeted. In some cases, the payoff can be made for 1-2-3,- all or the pool could be carried over with a special "daily" game played only on one or multiple specific days of the week. Alternatively, the bets can be placed only on-track as opposed to being available in off-track betting facilities. The carryover can build to conceivably $1,000,000 and be publicized to promote the track. This would be similar to the large, "progressive jackpots" offered by traditional slots in casinos.

There are virtually a limitless number of different variations for betting that can be programmed into the inventive system 10 using the above basic teachings. To keep the invention fresh and popular, these variations would be introduced just as variations are introduced into conventional slot machines from time to time.

The above system 10 is set up in a pari-mutuel racing format, as regulated by statute in most states. As a result, the use of the inventive system at live race tracks and at game facilities is permitted by law in most, if not all, jurisdictions, affording to the bettor the same thrill and advantage of conventional slot machines.

Of course, non-pari-mutuel type betting can take place using the inventive system. In this case, the random number generator 20 would determine payout based on underlying race or game results without using the pari-mutuel pooling and payout method. A fixed percentage payout of approximately 90–98% would be programmed into the random number generator's yield.

Alternatively, one large racing game can be conducted statewide. Smaller groups of 1–2 off-track betting facilities/tracks may adequately provide the necessary pool size and bet liquidity. This would protect against breakdowns and isolation of betting groups through hardware/software failure. Backup computers can be used to assure reliability in large systems, even those on a statewide basis.

The foregoing disclosure of specific embodiments is intended to be illustrative of the broad concepts comprehended by the invention.

I claim:

1. A method of wagering comprising the steps of:

providing a random number generator that has a wagering base which is randomly accessed through an input wager;

using as at least a part of the wagering base the outcome of at least one horse/dog race or jai alai game;

pre-assigning a probability value to the outcome of the at least one horse/dog race or jai alai game and programming the random number generator so that the probability of accessing the outcome of the at least one horse/dog race or jai alai game in the random number generator through an input wager is correlated to the probability value;

directing an input wager identifying the outcome of the at least one horse/dog race or jai alai game to the random number generator; and paying a return for an input wager identifying the outcome of the at least one horse/dog race or jai alai game that accesses the outcome of the at least one horse/dog race or jai alai game through the random number generator.

2. The method of wagering according to claim 1 including the steps of providing multiple locations from which input wagers are directed to the random number generator and directing input wagers to the random number generator from each of the multiple locations.

3. The method of wagering according to claim 2 wherein the step of paying a return comprises the step of paying a return that is determined by the number of input wagers identifying the outcome of the at least one horse/dog race or jai alai game that access the outcome of the at least one horse/dog race or jai alai game through the random number generator.

4. The method of wagering according to claim 2 including the step of identifying a predetermined wager period, the step of directing an input wager comprises the step of directing an input wager to the random number generator only during the predetermined wager period, and further including the step of paying a preliminary return amount for an input wager identifying the outcome of the at least one horse/dog race or jai alai game that accesses the outcome of the at least one horse/dog race or jai alai game through the random number generator before the expiration of the predetermined wager period.

5. The method of wagering according to claim 4 including the step of paying a final return amount for each input wager identifying the outcome of the at least one horse/dog race or jai alai game that accesses the outcome of the at least one horse/dog race or jai alai game through the random number generator during the predetermined wager period at the expiration of the predetermined wager period based upon the total number of input wagers identifying the outcome of the at least one horse/dog race or jai alai game from each of the multiple locations that access the at least one horse/dog race or jai alai game through the random number generator during the predetermined wager period.

6. The method of wagering according to claim 1 including the steps of providing additional information to define another part of the wagering base, pre-assigning a second probability value to the additional information and programming the random number generator so that the probability of accessing the additional information in the random number generator through an input wager identifying the additional information is correlated to the second probability value, providing an input wagering terminal with a selector to allow an input wager to be selectively identified as one of a) the outcome of the at least one horse/dog race or jai alai game and b) the additional information, directing an input wager identifying the additional information to the random number generator, and paying a return for an input wager identifying the additional information that accesses the additional information through the random number generator.

7. The method of wagering according to claim 1 including the steps of providing an input wagering terminal and processing a discrete object that is inserted into the input wagering terminal to cause an input wager identifying the outcome of the at least one horse/dog race or jai alai game to be directed to the random number generator.

8. The method of wagering according to claim 7 wherein the input wagering terminal has a repositionable element that is accessible to an operator, and the step of processing a discrete object comprises the step of repositioning the repositionable element after the discrete object is inserted into the input wagering terminal.

9. The method of wagering according to claim 2 including the steps of identifying a money value for each input wager and determining a cumulative money pool value for the total input wagers made from the multiple locations identifying the outcome of the at least one horse/dog race or jai alai game that access the outcome of the at least one horse/dog race or jai alai game through the random access generator, and the step of paying a return comprises the step of paying a return to each input wager identifying the outcome of the at least one horse/dog race or jai alai game that accesses the at least one horse/dog race or jai alai game based on the cumulative money pool value.

10. The method of wagering according to claim 1 including the steps of providing an input wagering terminal and at the input wagering terminal producing at least one of an audio and visual signal to at least one of a) simulate an equestrian event, b) simulate a live race environment, c) assist placement of input wagers, d) identify the beginning of a wagering period, e) identify the end of a wagering period, and f) simulate a live game environment.

11. The method of wagering according to claim 1 including the steps of providing additional information to define another part of the wagering base, pre-assigning a second probability value to the additional information, programing the random number generator so that the probability of accessing the additional information in the random number generator is correlated to the second probability value, and providing an input wagering terminal that causes an input wager directed to the random number generator to randomly be identified as at least one of a) the outcome of the at least one horse/dog race or jai alai game, and b) the additional information.

12. A wagering system comprising:

a random number generator that has a wagering base which is randomly accessed by an input wager, said wagering base comprising the outcome of at least one horse/dog race or jai alai game with a preassigned probability of accessing the outcome of the at least one horse/dog race or jai alai game through each input wager; and a first input wagering terminal for directing an input wager identifying the outcome of the at least one horse/dog race or jai alai game to the random number generator.

13. The wagering system according to claim 12 including a second input wagering terminal for directing an input wager identifying the outcome of the at least one horse/dog race or jai alai game to the random number generator.

14. The wagering system according to claim 13 including a processor for deterring the number of input wagers identifying the at least one horse/dog race or jai alai game directed from the first and second input wagering terminals to the random number generator s the at least one horse/dog race or jai alai game in the random number generator.

15. The wagering system according to claim 12 wherein the first input wagering terminal includes an actuator switch for causing an input wager to be directed to the random number generator.

16. The wagering system according to claim 12 wherein the wagering base comprises additional information that defines another part of the wagering base with there being a preassigned probability of accessing the additional information through each input wager identifying the additional information, the first input wagering terminal comprises a selector that can be set in first and second states, said selector in the first state causing an input wager identifying the outcome of the at least one horse/dog race or jai alai game to be directed to the random number generator, said selector in the second state causing the input wager to cause an input wager identifying the additional information to be directed to the random number generator.

17. The wagering system according to claim 12 wherein the wagering base comprises additional information that defines another part of the wagering base with a preassigned probability of accessing the additional information through each input wager identifying the additional information, and the first input wagering terminal comprises a selector for causing an input wager directed to the random number generator to be randomly identified as the at least one horse/dog race or jai alai game and the additional information.

18. The wagering system according to claim 12 wherein there are means at the terminal for producing at least one of an audio and visual signal to at least one of a) simulate an equestrian event, b) simulate a live race environment, c) assist placement of input wagers, d) identify the beginning of a wagering period, e) identify the end of a wagering period, and f) simulate a live game environment.

19. The wagering system according to claim 12 wherein the wagering base comprises additional information that defines another part of the wagering base with a preassigned probability of accessing the additional information through each input wager identifying the additional information, and the additional information comprises information on the outcome of a horse/dog race or jai alai game.

20. The wagering system according to claim 19 wherein at least one of the preassigned probabilities is substantially the same as the probability of the outcome of the horse/dog race or jai alai game to which it relates.

21. The wagering system according to claim 12 wherein the first input wagering terminal comprises means responsive to the insertion of a discrete object by an operator to direct and input wager to the random number generator.

* * * * *